United States Patent [19]

Levi et al.

[11] Patent Number: 4,949,809

[45] Date of Patent: Aug. 21, 1990

[54] EXTENDABLE POLE LOCKING MECHANISM FOR LADDER STABILIZER

[75] Inventors: Avraham Y. Levi, St. Paul; Craig D. Quarberg, Brooklyn Park, both of Minn.

[73] Assignee: A. C. Innovations, Inc., Bloomington, Minn.

[21] Appl. No.: 447,194

[22] Filed: Dec. 7, 1989

[51] Int. Cl.[5] ..... E06C 5/36; E06C 1/22

[52] U.S. Cl. ..... 182/172; 248/354.1

[58] Field of Search ..... 182/172, 169, 170; 248/354.1

[56] References Cited

U.S. PATENT DOCUMENTS 4,872,529 10/1989 Viets ..... 182/172

4,899,849 2/1990 Levi et al. ..... 182/172

*Primary Examiner*—Reinaldo P. Machado

*Attorney, Agent, or Firm*—Haugen and Nikolai

[57] ABSTRACT

A locking mechanism for fixing the first and second telescopingly disposed tubular poles longitudinally relative to one another includes a longitudinally extending channel of rectangular cross-section projecting radially from the outermost tube and running the length thereof and an elongated rack having a plurality of spaced, parallel teeth projecting radially outward from the inner tubular member and fitted into the channel of the outer tubular member. Affixed to one end of the outer tubular member is a sleeve on which is rotatably mounted a locking ring having a notch extending along the width dimension thereof and a plurality of parallel, arcuate spaced-apart teeth circumferentially adjacent the notch. When the rack on the inner tubular member is aligned with the notch in the ring, the outer and inner tubular poles can slide relative to one another. By then rotating the locking ring, its teeth are made to mesh with the teeth on the rack of the inner tubular member, preventing further longitudinal displacement between the telescoping pole segments.

5 Claims, 2 Drawing Sheets

EXTENDABLE POLE LOCKING MECHANISM FOR LADDER STABILIZER

BACKGROUND OF THE INVENTION

I. Field of the Invention

This invention relates generally to ladder stabilizing apparatus of the type disclosed in U.S. patent application Ser. No. 07/280,124, filed Dec. 5, 1988, and entitled "LADDER STABILIZER", and more particularly to an improved locking arrangement for selectively allowing or inhibiting longitudinal sliding motion between two telescoping poles.

II. Discussion of the Prior Art

In our above-referenced patent application, we disclose ladder stabilizing apparatus for an extension-type ladder to prevent accidental tipping or sliding of the ladder and injury to a workman. That device includes a pair of telescopingly extensible and retractable tubular pole members which are individually connected at one end thereof to the side rails of the ladder by hinge blocks and hinge pins. A folding brace is disposed between the ladder rails and the uppermost one of the telescoping tubes to establish the extent of displacement between the ladder rails and the deployed stabilizing legs. In that arrangement, a cam lock is deployed between segments of the telescoping tubular pole members to facilitate adjustment of the length thereof. The most often used approach to a locking mechanism has been the rather old idea of providing apertures through the walls of the telescoping tubes allowing a locking pin to be inserted therethrough. However, when it is considered that the pole length needs to be substantially continuously adjustable to accommodate a variety of uneven terrain conditions which might be encountered when using ladders, the provision of parallel holes along the lengths of the telescoping tubular members at closely spaced locations would so drastically weaken the strength of the pole members that such an arrangement becomes impractical and dangerous.

OBJECTS

It is accordingly the object of the present invention to provide an improved, positive locking mechanism for fixing the length of two telescoping poles.

Another object of the invention is to provide a positive locking mechanism for two telescopingly slidable poles which does not unduly weaken the poles against bending and breakage.

Yet another object of the invention is to provide a self-contained, positive locking mechanism between two telescoping adjustable length pole segments which is easy to engage and disengage and which does not require any special tools or precise alignment of the parts relative to one another.

Still another object of the invention is to provide ladder stabilizing legs in which telescoping tubular segments are hinged to the ladder's rails and in which the cross-brace supports are relocated to be close to the feet of the tubular segments whereby bending forces on the legs are minimized.

SUMMARY OF THE INVENTION

The foregoing objects and features of the invention are achieved by providing an outer tubular pole member having a circular cross-section except for a radially extending channel having a rectangular cross-section protruding from its side wall. The lower, inner tubular member has an outside diameter slightly less than the inside diameter of the upper, outer tubular member and it includes an elongated, radially projecting rack dimensioned so as to ride within the channel on the outer tubular member when the two tubes are coaxially (telescopingly) disposed relative to one another. The rack on the inner tube includes a plurality of longitudinally spaced notches which define spaced-apart teeth on the rack.

Affixed to one end of the outer pole is a sleeve member and disposed on the sleeve is a rotatable locking ring having a notch formed across its width or height dimension, the notch being dimensioned to receive the rack on the inner tubular member. Also formed on the internal surface of the locking ring are a plurality of regularly spaced parallel, arcuate teeth which are adapted to mesh with the teeth on the rack when the locking ring is appropriately rotated so that the rack is no longer aligned with the notch of the locking ring.

In use, then, the inner tubular pole member can be extended relative to the outer tubular pole member until the ladder stabilizing legs are a desired length. Then, by simply rotating the locking ring a quarter of a turn, further longitudinal movement between the pole segments is precluded. A cross-brace connects between the ladder's side rails and the lower inner tubular member proximate the foot end thereof to reduce the bending effect on the legs by laterally directed forces.

DESCRIPTION OF THE DRAWINGS

The foregoing features and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
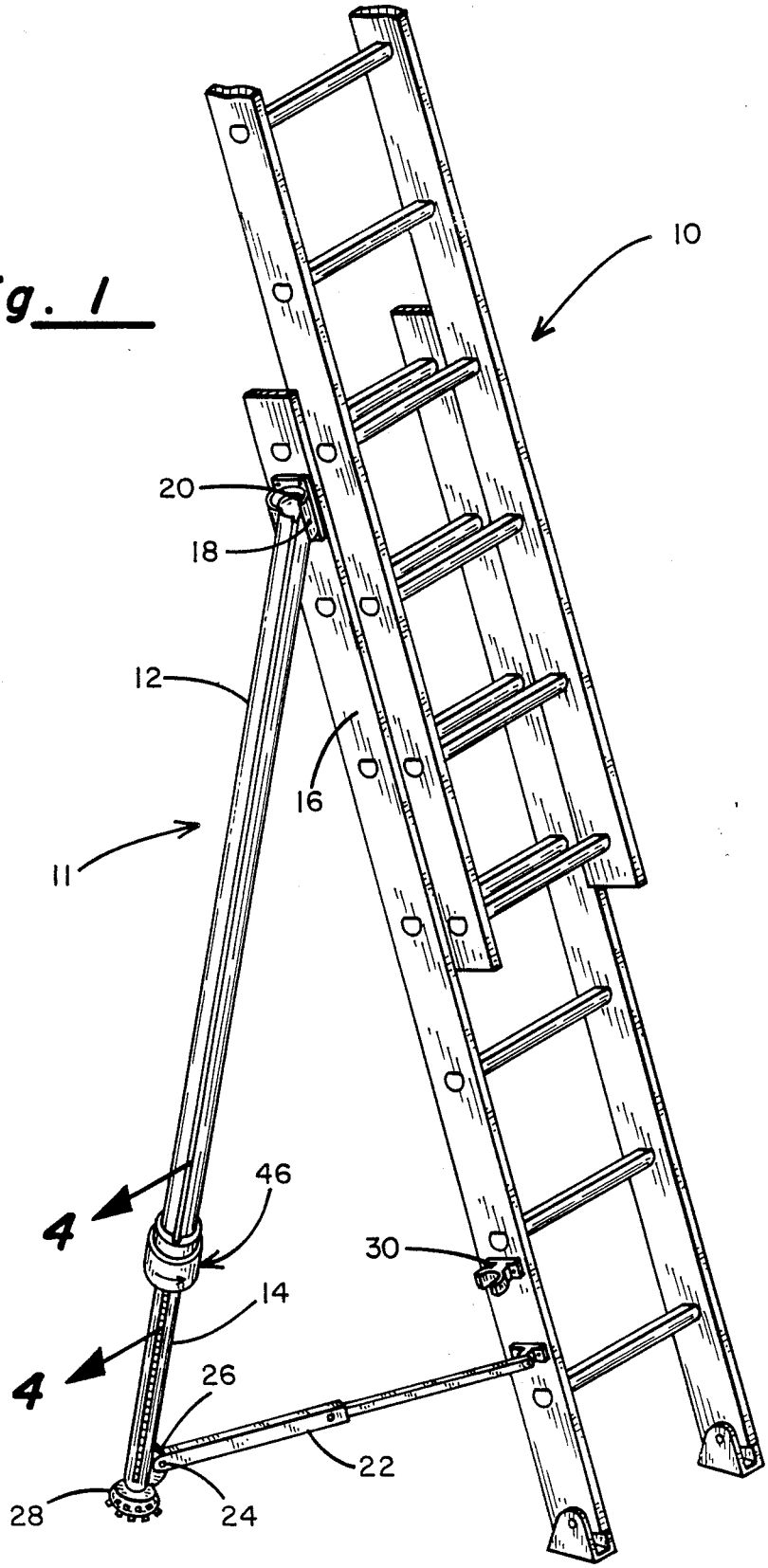
FIG. 1 is a perspective view of an extension ladder having a ladder stabilizing member incorporating the locking feature of the present invention attached to it.

Referring to FIG. 1, there is indicated generally by numeral 10 an extension ladder having a pair of ladder stabilizers 11 attached to the side rails thereof, only one of which is shown. The ladder stabilizers are intended to be used as is generally described in the aforereferenced pending patent application to prevent accidental sliding of the base of the ladder or sideways tipping of the ladder, especially when a workman is leaning to the side to accomplish work. As in our earlier system, the ladder stabilizer comprises an outer elongated tubular pole member 12 having a central opening into which is telescopingly fitted an inner tubular member 14. The outer tube 12 is coupled to the side rails 16 of the extension ladder by a pin 18 which passes through a hinge bracket 20 and the upper end of the pole 12. The extent to which the telescoping pole assembly can be splayed out relative to the side rail 16 of the ladder is governed by a hinged linkage 22. Rather than being secured to the outer tube 12 as in our earlier design, one end of linkage 22 is pivotally secured at 24 to an ear 26 integrally molded to a foot pad member 28 affixed to the inner segment 14. By pushing upward on the linkage 22, the telescoping legs can be stowed against the side rail 16 with the lower tubular leg portion 14 secured in a clamp 30.

The foregoing is set forth to generally describe the arrangement of the parts comprising the ladder stabilizer. The present invention, however, resides in the particular mechanism used to lock the inner tube or pole 14 relative to the outer tube or pole 12 at a desired extension length. Hence, the remaining portion of the specification is directed to the particulars of this locking arrangement.

Figure 2:
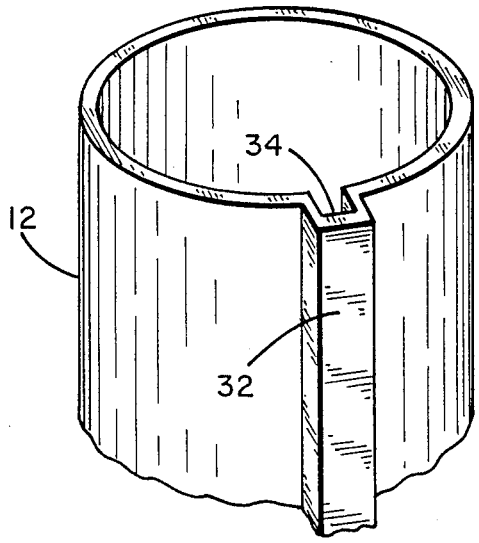
FIG. 2 is an enlarged perspective view of a segment of the outer tubular member of FIG. 1.
Figure 3:
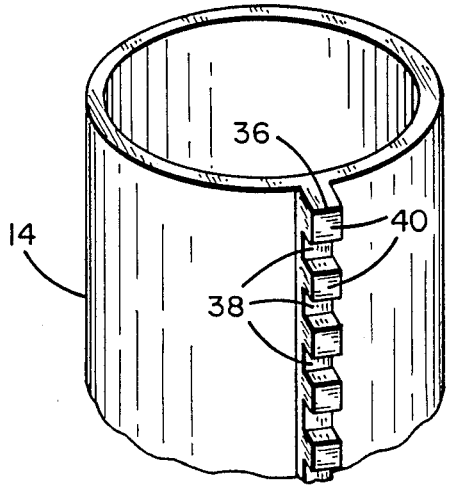
FIG. 3 is an enlarged perspective view of a segment of the inner tubular member of FIG. 1.

Referring to FIGS. 2 and 3, the outer pole 12 is seen to be generally tubular and circular in cross-section, except for an integrally formed channel 32 which projects radially outwardly from the exterior wall to form a longitudinal notch or groove 34 which extends along the entire length of the outer tubular pole member 12. The tubular pole member 12 is preferably formed in an extrusion process and, as such, the channel-like projection 32 may be easily created by providing an appropriately shaped die in the extruder. The tubular member 12 is preferably made from aluminum because of its lightweight but it is to be understood that other materials such as fiberglass can be extruded and will possess the requisite strength for the ladder stabilizing application.

FIG. 3 illustrates a segment of the inner tubular member 14 and it also is seen to be generally circular in cross-section except that it is formed to have a longitudinally extending rack 36 whose width and height dimensions permit it to pass through the notch or groove 34 in the channel 32 of the outer tubular member 12. At regular intervals along the length of the rack 36 are cut notches, as at 38, which thus create radially projecting teeth 40 therealong.

Figure 4:
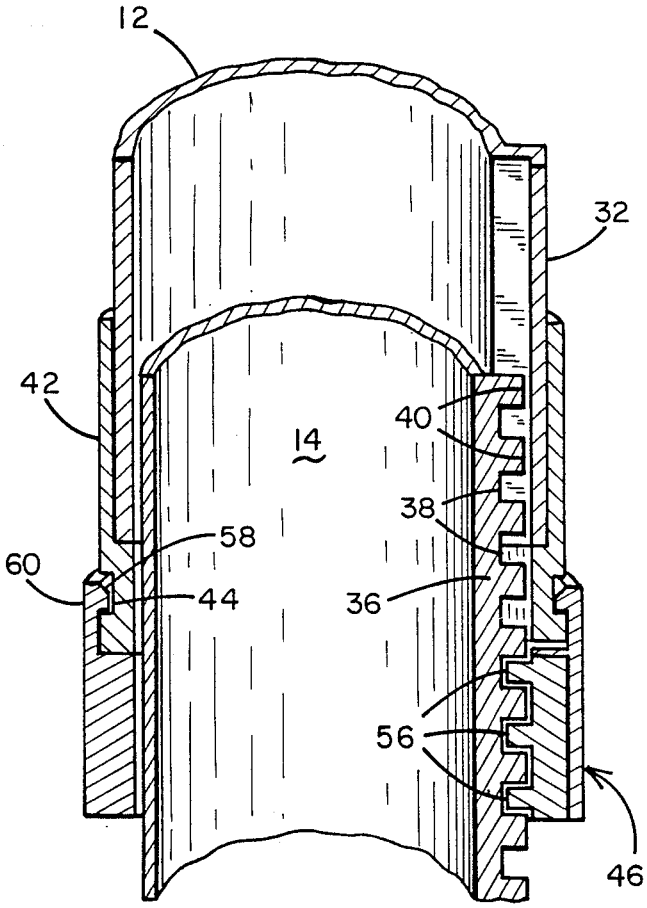
FIG. 4 is an enlarged cross-sectional view taken along the lines 4—4 in FIG. 1.
Figure 5:
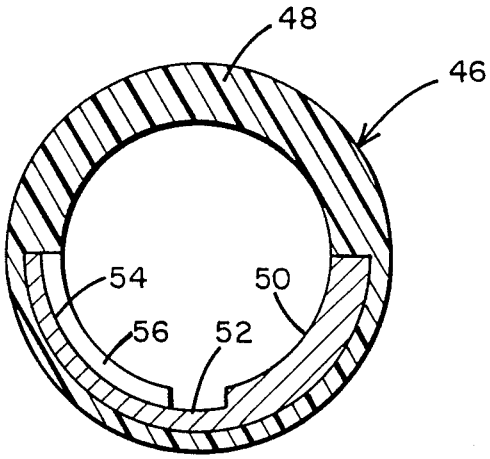
FIG. 5 is a horizontal cross-sectional view of the locking ring portion of FIG. 4.

Referring now to FIG. 4, there is shown a cross-sectional view taken along the lines 4—4 in FIG. 1 and showing the internal construction of the locking mechanism employed to lock the two pole segments relative to one another or to release them for sliding motion therebetween. Secured to the lower end of the outer pole member 12 is an aluminum or plastic sleeve 42 which is preferably press-fit onto the tube 12 and which includes an annular groove 44 formed in its exterior surface. A two-piece locking ring, indicated generally by numeral 46, is fitted onto the sleeve 42 and is free to rotate about the longitudinal axis of the pole assemblies. Specifically, and with reference to FIG. 5, the locking ring 46 includes an outer molded plastic segment 48 and an aluminum insert 50 fitted therein. The insert 50 includes a notch 52 longitudinally extending the entire height dimension of the ring and sized so as to accommodate the rack 36 therein. That is to say, when the rack 36 is aligned with the notch 52, the inner tubular pole member 14 can be extended and retracted relative to the outer tubular member 12.

Adjacent to the notch 52 of the insert 50 are a plurality of parallel, spaced-apart arcuate grooves, as at 54, to define a plurality of arcuate circumferentially extending teeth 56 therebetween. The spacing between adjacent teeth corresponds to the spacing between the teeth 40 on the rack 36.

The ring 46 may readily be fitted onto the sleeve 42 by applying sufficient force between the bottom of the sleeve 42 and the upper chamfered surface 58 of the plastic exterior 48 of the ring to spread the plastic so as to clear the bottom portion of the sleeve 42 until the upper plastic portion 60 of the locking ring snaps into the annular groove 44 of the sleeve.

From what has been described, it can be appreciated that so long as the notch 52 of the locking ring is aligned with the rack 36 on the exterior of the inner tube, that inner tube may be extended and retracted relative to the outer tube 12. When the extension of the inner tube relative to the outer tube is at a desired point, a simple quarter rotation of the locking ring 46 will cause the teeth 56 thereof to mesh with the teeth 40 on the rack 36 to prevent any motion between the inner and outer tubular members 12 and 14.

The ladder stabilizer of the present invention also differs from the embodiment disclosed in the aforereferenced application Ser. No. 07/280,124 in that rather than having a folding cross-brace extending between the ladder's side rails and the legs proximate the lower end of the uppermost (outer) tubular segment, in the present invention, the hinged linkage 22 comprising the cross-brace is fastened at one end to the ladder's side rail proximate the feet thereof and to the lower end of the inner tubular segment 14 near its foot or base 28. It has been found that repositioning the brace in this fashion reduces the tendency of the stabilizing legs to bend when subjected to laterally directed forces.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A releasable locking mechanism for inhibiting longitudinal sliding motion between two concentrically disposed tubular pole members comprising:

(a) an outer tubular pole member having a generally circular cross-section except for an integrally formed channel of rectangular cross-section extending radially therefrom along the length of said outer tubular pole member;

(b) an inner tubular pole member having a generally circular cross-section and an outer diameter slightly less than the internal diameter of said outer tubular pole member with a toothed rack of rectangular cross-section extending radially therefrom along the length of said inner tubular pole member, said inner tubular pole member being fitted in telescoping relation within said outer tubular pole member with said toothed rack fitted within said channel for sliding relation therein; and (c) a locking ring rotatably coupled to said outer tubular member, said locking ring including a plurality of parallel, arcuate teeth for selectively meshing with the teeth on said toothed rack and a rectangular notch circumferentially adjacent said arcuate teeth, which when aligned with said toothed rack allows longitudinal sliding of said inner tubular pole member relative to said outer tubular pole member.

2. The locking mechanism as in claim 1 wherein said locking ring comprises an outer plastic sleeve surrounding a metal insert and wherein said parallel arcuate teeth and said rectangular notch are formed in said metal insert.

3. The locking mechanism as in claim 1 wherein the upper end of said outer tubular member is pivotally attached to a side rail of a ladder for stabilizing said ladder against lateral and rearward movement of the foot of said ladder.

4. The locking mechanism as in claim 3 and further including a folding brace pivotally joined between the lower end portion of said inner tubular pole member and said side rail of said ladder proximate said foot of said ladder.

5. The locking mechanism as in claim 2 and further including a sleeve member affixed to an end of said outer tubular member and including an annular groove therein for receiving a portion of said outer plastic sleeve therein.

* * * * *